US005239952A

United States Patent [19]

Morita

[11] Patent Number: 5,239,952

[45] Date of Patent: Aug. 31, 1993

[54] VALVE ACTUATING APPARATUS

[75] Inventor: Shoji Morita, Kanagawa, Japan

[73] Assignee: Atsugi Unisia Corporation, Atsugi, Japan

[21] Appl. No.: 972,965

[22] Filed: Nov. 6, 1992

[30] Foreign Application Priority Data

Nov. 8, 1991 [JP] Japan ..... 3-91745[U]
Nov. 8, 1991 [JP] Japan ..... 3-91753[U]

[51] Int. Cl.[5] ..... F01L 1/34
[52] U.S. Cl. ..... 123/90.16; 123/90.39
[58] Field of Search ..... 123/90.15, 90.16, 90.22, 123/90.39, 90.4, 90.41, 90.44, 90.45

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,556,025 | 12/1985 | Morita | 123/90.16 |
| 4,612,884 | 9/1986 | Ajiki et al. | 123/90.16 |
| 4,726,332 | 2/1988 | Nishimura et al. | 123/90.16 |
| 5,046,462 | 9/1991 | Matayoshi et al. | 123/90.39 |
| 5,085,182 | 2/1992 | Nakamura et al. | 123/90.39 |
| 5,099,806 | 3/1992 | Murata et al. | 123/90.16 |
| 5,183,015 | 2/1993 | Morita et al. | 123/90.16 |

FOREIGN PATENT DOCUMENTS

| | | |
|---|---|---|
| 0442460 | 8/1991 | EPO . |
| 0420159 | 4/1991 | EPO . |
| 63167016 | 7/1988 | Japan . |
| 6357806 | 3/1988 | Japan . |

*Primary Examiner*—E. Rollins Cross
*Assistant Examiner*—Weilun Lo
*Attorney, Agent, or Firm*—Bachman & LaPointe

[57] ABSTRACT

A valve actuating system comprises a rocker arm supported by a rocker shaft for contacting with a first or low speed profiled cam lobe and a valve stem, a lost motion mechanism, a free cam follower and a prop. The lost motion mechanism includes a stationary portion defining a pedestal fixed to the rocker arm and a moveable portion received by the stationary portion. The free cam follower includes a cam face adapted for contacting with a second or high speed profiled cam lobe. The prop is supported by the free cam follower for movement between a first position in which the prop supports the free cam follower on the moveable portion of the lost motion mechanism and a second position in which the prop supports the free cam follower on the pedestal of the lost motion mechanism. The free cam follower has a bore and the prop has a plunger part received in the bore and cooperating with the bore defining wall for unitary rotation of the prop with the free cam follower. The lost motion mechanism and the prop cooperate with each other to hold the cam face in a predetermined relationship with the second cam lobe.

15 Claims, 9 Drawing Sheets

VALVE ACTUATING APPARATUS

RELATED APPLICATIONS

U.S patent application Ser. No. 07/873,362, now U.S. Pat. No. 5,183,015, entitled "VALVE OPERATING APPARATUS" filed on Apr. 24, 1992 by Shoji Morita et al., and commonly assigned herewith; and German Patent Application No. P 42 13 865.5 filed on Apr. 27, 1992.

BACKGROUND OF THE INVENTION

The present invention relates to a valve actuating apparatus for an engine.

Japanese Patent Application First (unexamined) Publication Nos. 63-57806 and 63-167016 disclose a valve actuating apparatus. The known valve actuating apparatus comprises a mechanism to releasably interconnect the adjacent two rocker arms which are engaged with a low speed cam lobe and a high speed cam lobe integral with a camshaft, respectively. The rocker arms are formed with mating bores receiving a plunger. The plunger is moveable between a first position in which the plunger is disposed in one of the mating bores and a second position in which the plunger is inserted into the other plunger and thus disposed in both of the mating bores. When the plunger is in the first position, the two rocker arms move separately, while when the plunger is in the second position, they move as a unit.

Owing to the use of the plunger and mating bores, this mechanism requires a high degree of accuracy in machining the mating bores and the plunger.

There has been proposed a valve actuating apparatus which does not use a plunger nor bores which demand high degree of accuracy to machine.

The copending U.S. patent application Ser. No. 07/873,362 and German Patent Application No. P 42 13 865.5 disclose a valve actuating apparatus of this kind. This apparatus comprises a rocker arm supported by a rocker shaft for contacting with a first or low speed cam lobe and a valve stem, a lost motion mechanism, a free cam follower and a prop. The lost motion mechanism includes a stationary portion defining a pedestal fixed to the rocker arm and a moveable portion received by the stationary portion. The free cam follower includes a cam face adapted for contacting with a second or high speed cam lobe. The prop is supported by the free cam follower for movement between a first position in which the prop supports the free cam follower on the moveable portion of the lost motion mechanism and a second position in which the prop supports the free cam follower on the pedestal of the lost motion mechanism.

For reliable operation of this valve actuating apparatus, it is required to hold the cam face of the free cam follower in a predetermined relationship with the second cam lobe, and it is also required that the free cam follower supports the prop rigidly against torque applied to the prop, but loosely enough to allow quick and smooth movement of the prop between the first position thereof and the second position thereof.

Thus, there is still a demand on high accuracy in machining parts in order to keep the product-by-product variability sufficiently low, making a reduction in manufacturing cost difficult.

An object of the present invention is to improve the previously proposed valve actuating apparatus of the kind which is disclosed in U.S. patent application Ser. No. 07/873,362 and German Patent Application No. P 42 13 865.5 such that the degree of accuracy in machining parts may be lowered with the product-by-product variability kept sufficiently low and thus a reduction in manufacturing cost results.

SUMMARY OF THE INVENTION

According to the present invention, there is provided an apparatus for actuating a valve of an engine having a camshaft with a first cam lobe and a second cam lobe, the valve having a valve stem, comprising:

a rocker shaft having an axis;

a rocker arm supported by said rocker shaft for rotational movement about said axis and adapted for contacting with said first cam lobe and the valve stem;

a lost motion mechanism including a stationary portion defining a pedestal fixed to said rocker arm and a moveable portion received by said stationary portion for movement relative to said stationary portion;

a free cam follower including a cam face adapted for contacting with said second cam lobe;

a prop supported by said free cam follower for movement between a first position in which said prop supports said free cam follower on said moveable portion of said lost motion mechanism and a second position in which said prop supports said free cam follower on said pedestal, wherein said free cam follower has a bore and wall means defining said bore, and said prop has a plunger part received in said bore and cooperating with said bore defining wall means for unitary rotation of said prop with said free cam follower, and said lost motion mechanism and said prop cooperate with each other to hold said cam face in a predetermined relationship with said second cam lobe.

DETAILED DESCRIPTION OF THE INVENTION

Figure 1:
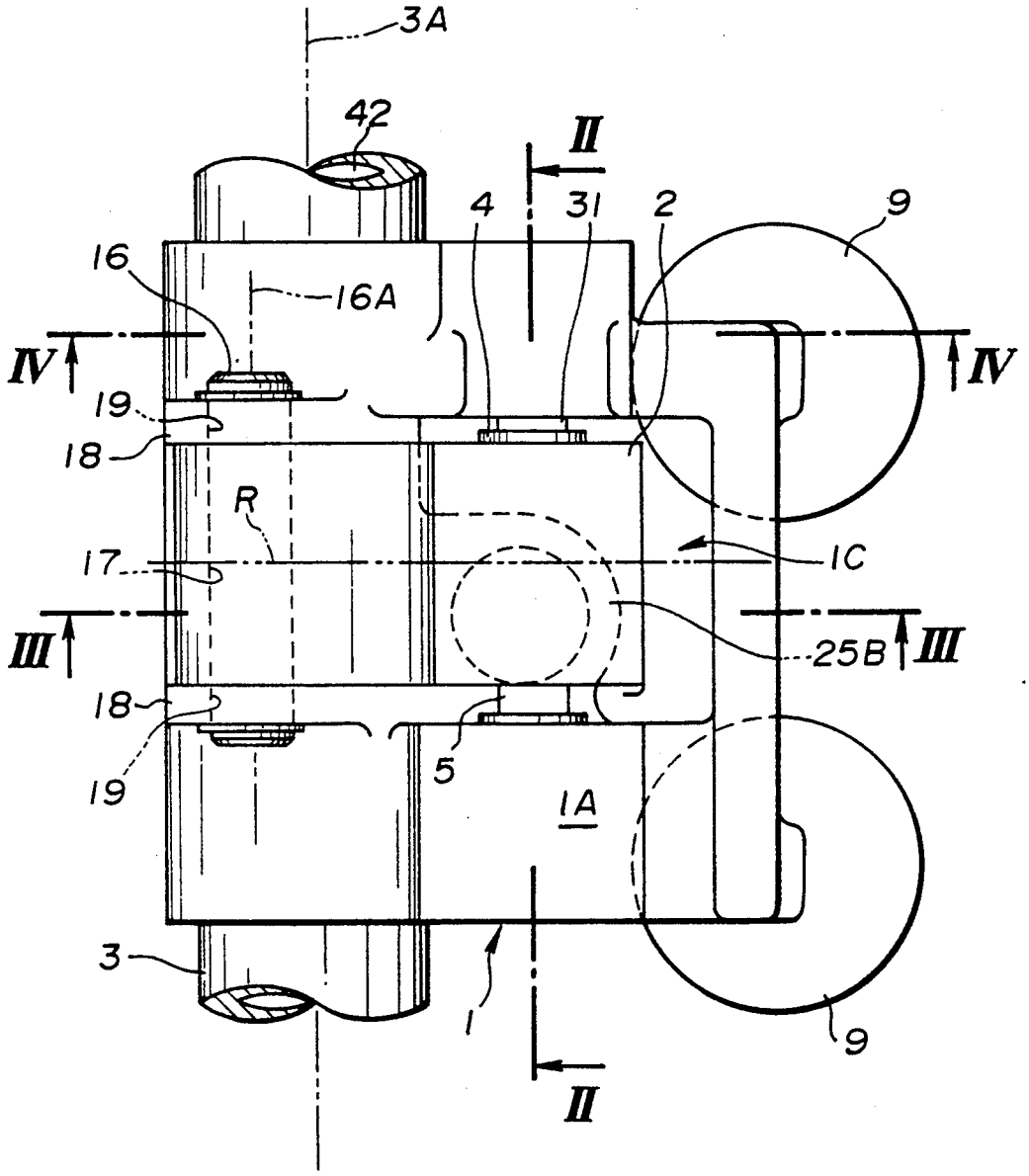
FIG. 1 is a plan view of a first embodiment of an apparatus according to the present invention.

Referring to the accompanying drawings, like reference numerals or characters are used throughout all of the Figures to designate like or similar parts.

Referring to FIGS. 1 to 7, the first embodiment of an apparatus according to the present invention is described. In this embodiment and the subsequently described embodiments as well, the invention is embodied with an engine having per cylinder two valves with the same function, e.g., two intake valves or two exhaust valves.

In FIG. 1, there are shown two poppet type intake valves 9 which are provided for each of cylinders of an internal combustion engine. The valves 9 per cylinder have valve stems, respectively, only one being shown at 9A in FIG. 3. A rocker arm 1 is supported by a rocker shaft 3 mounted to a cylinder head of the engine. The rocker shaft 3 has an axis 3A and the rocker arm 1 is supported for rotational movement about the axis 3A. As is readily seen from FIGS. 1 and 3, the rocker arm 1 has two parallel extending portions adapted for contacting with the valve stems 9A, respectively.

Defined between the two parallel extending portions of the rocker arm 1 is a space 1C. This space 1C is axially limited, with respect to the axis 3A, by two spaced walls of the parallel extending portions (see FIGS. 1 and 2).

Figure 2:
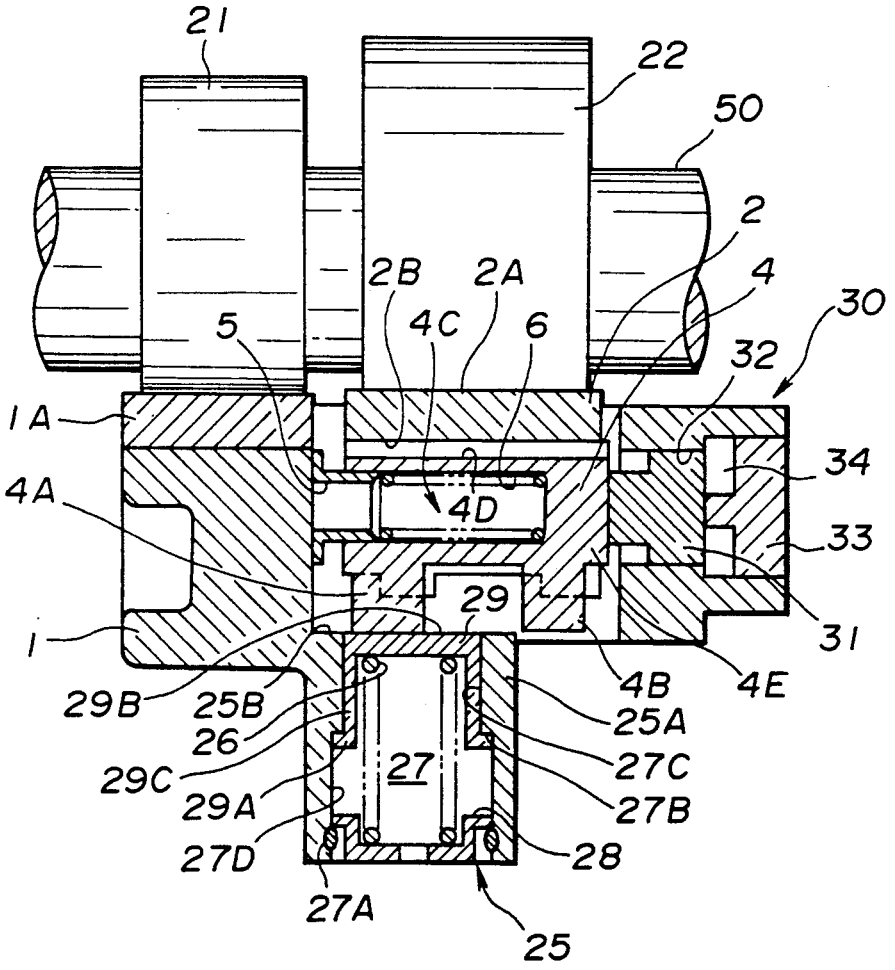
FIG. 2 is a section taken through the line II—II in FIG. 1, showing a prop in a first position.
Figure 5:
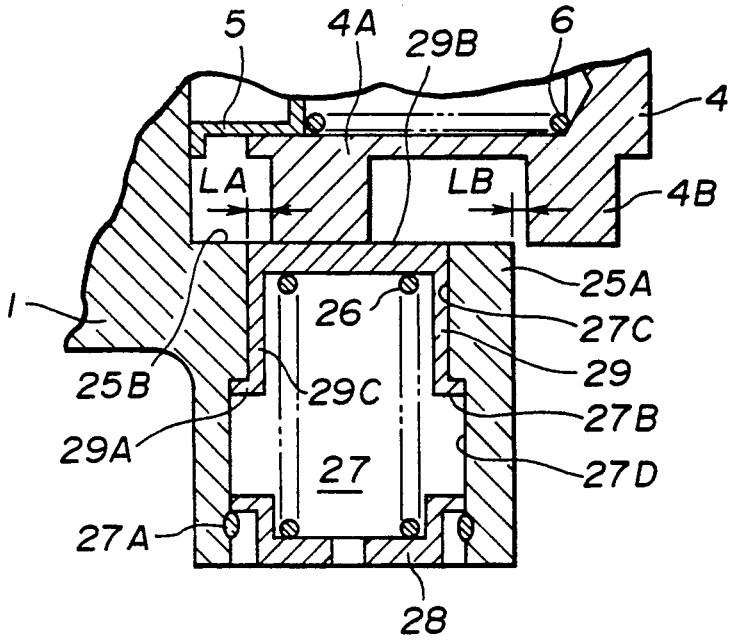
FIG. 5 is an enlarged fragmentary view of FIG. 2.

As viewed in FIGS. 2 and 3, a lost motion mechanism generally designated by the reference numeral 25 is disposed below this space 1C. As best seen in FIG. 5, the lost motion mechanism 25 includes a stationary portion in the form of a barrel 25A formed integrally with the rocker arm 1. The barrel 25A has an upper or top face defining a pedestal 25B. The pedestal 25B is fixed to the rocker arm 1 since the barrel 25A is an integral part of the rocker arm 1. The barrel 25A is formed with a stepped bore 27. This bore 27 includes a first bore section 27C and a second reduced diameter bore section 27D which is reduced in diameter relative the first bore section 27C and connected to the first bore section via a shoulder 27B. Slidably received in the reduced diameter bore section 27D is a moveable portion in the form of a cup-like spring retainer 29. An end plug 28 is disposed in the bore section 27C and fixed thereto by means of a stop ring 27A. A spring 26 is disposed in the bore 27 and acts between the end plug 28 and the spring retainer 29. This spring retainer 29 has an upper wall with an end face 29B and a tubular wall 29C slidably fit in the reduced diameter bore section 27C. The tubular wall 29C has an upper end, viewed in FIG. 5, closed by the end face 29B and the opposite lower end formed with a radially outwardly extending annular flange 27B adapted for engagement with the shoulder 29A. In a spring set rest position as illustrated in FIG. 2, the spring retainer 29 does not project out of the bore 27 owing to engagement of the flange 29A with the shoulder 27B. In this embodiment, the end face 29B is kept as high as the pedestal 25B adjacent the edge of the bore 27.

Referring again to FIGS. 1 and 2, a camshaft 50 has a first cam lobe 21 and a second cam lobe 22 formed integrally therewith. The camshaft 50 is mounted to the cylinder head of the engine in a parallel relationship with the rocker shaft 3. The first cam lobe 21 is a low speed profiled cam lobe, while the second cam 22 is a high speed profiled cam lobe. The rocker arm 1 has a cam face portion 1A for contacting with the first cam lobe 21. Adjacent to this cam face portion 1A is a cam face 2A of a free cam follower 2. The cam face 2A is adapted for contacting with the second cam lobe 22.

The rocker arm 1 has two axially spaced standing walls 18 formed with bores 19. The free cam follower 2 is mounted to the rocker arm 1 for rotatable movement about an axis 16A of a sub-rocker shaft 16. The free cam follower 2 and has its ends fixedly received in the bores 19 of the standing walls 18 such that the axis 16A is held in a predetermined parallel and spaced relationship with the axis 3A of the rocker shaft 3. As viewed in in FIG. 3, the sub-rocker shaft 16 is disposed to the left side from the vertical center line of the rocker shaft 3.

Figure 7:
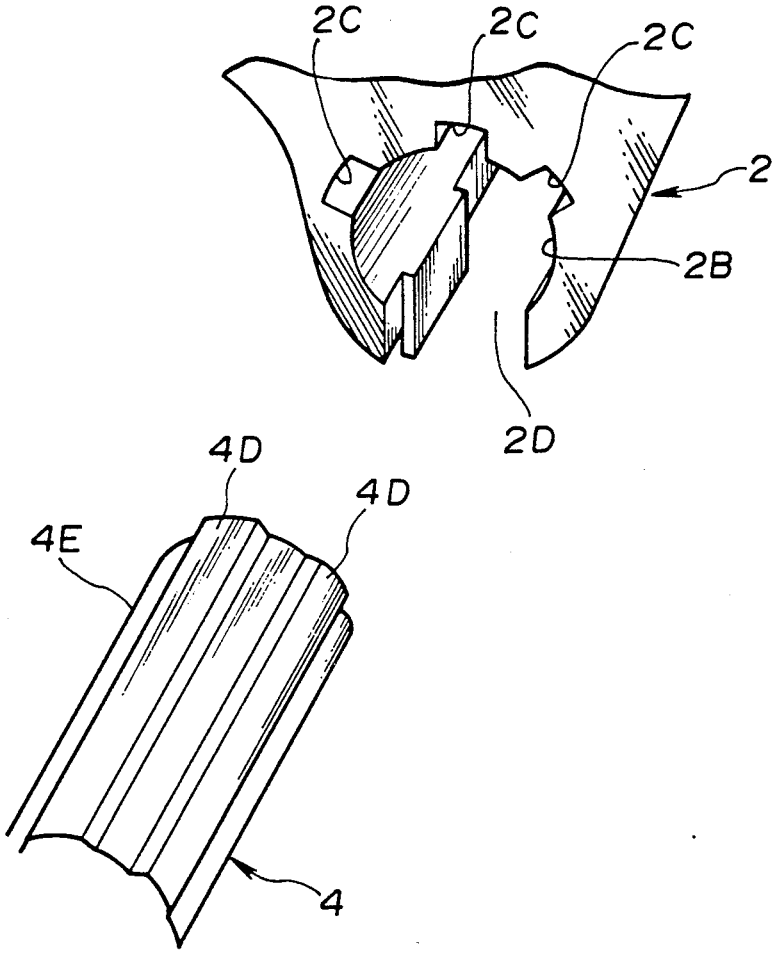
FIG. 7 is a fragmentary exploded view showing projections with which the prop is formed and slots with which a bore defining wall of a free cam follower is formed.

Different from the rocker arm 1, the free cam follower 2 has no portion adapted for contacting with the valve stems 9A. As best seen in FIG. 3, the free cam follower 2 extends into the space 1C and is disposed between the second cam lobe 22 and the lost motion mechanism 25. The free cam follower 2 has a bore and a wall 2B defining the bore. As best seen in FIG. 7, the bore defining wall 2B includes a plurality of slots 2C adapted for slidably receiving a plurality of projections 4D, respectively, with which a plunger part 4E of a prop 4 is formed.

Figure 3:
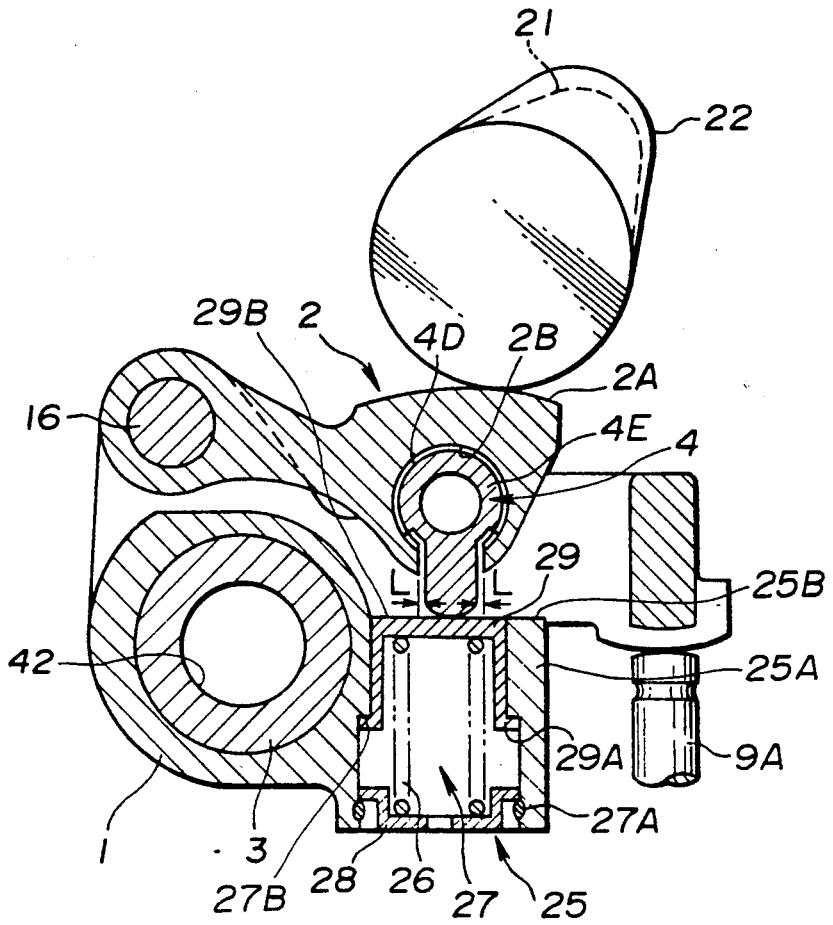
FIG. 3 is a section taken through the line III—III in FIG. 1.

Referring to FIG. 3, the prop 4 is received in the bore defined by the wall 2B. This bore extends in a parallel relationship with the sub-rocker shaft 16 and has its one and opposite ends opened as readily seen from FIG. 2. As best seen in FIG. 7, the free cam follower 2 is formed with a longitudinal slit 2D cut along the bore defining wall 2B.

Referring to FIGS. 2 and 5, the prop 4 has a leading leg 4A and a trailing leg 4B which extend radially outwardly from the plunger part 4E. These legs 4A and 4B are spaced in a longitudinal direction of the plunger part 4E and disposed in the longitudinal slit 2D.

Figure 6:
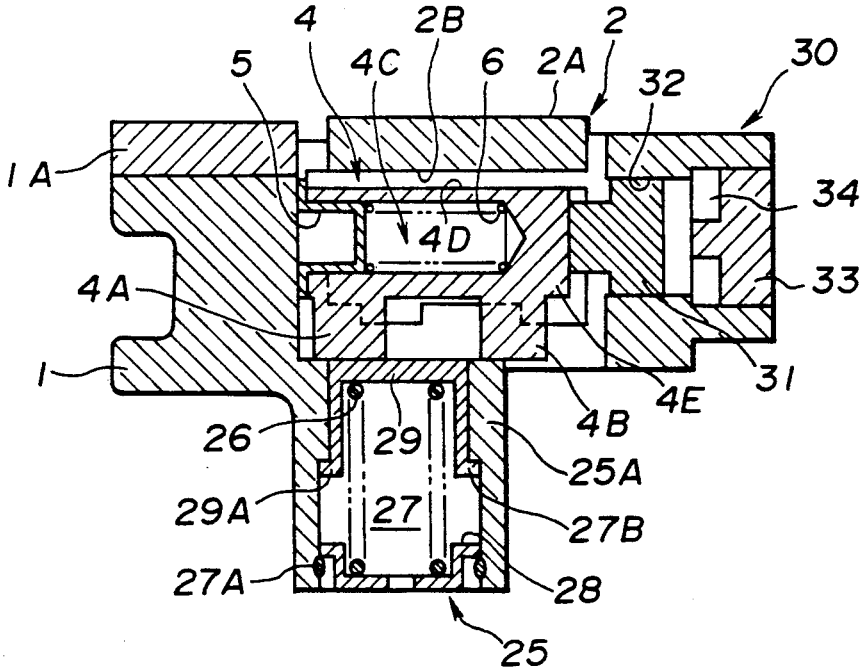
FIG. 6 is a similar view to FIG. 2 showing the prop in a second position.

Referring to FIGS. 2 and 6, the prop 4 is moveable between a first position as illustrated in FIG. 2 and a second position as illustrated in FIG. 6. In the first position, the prop 4 has the leading leg 4A in engagement with the end face 29B of the spring retainer 29 and the trailing leg 4B out of engagement with the end face 29B nor the pedestal 25B in order to support the free cam follower 2 on the spring retainer 29. In the second position, the prop 4 has the leading leg 4A in engagement with both the end face 29B and the adjacent portion of the pedestal 25B and the trailing leg 4B is in engagement with another portion of the pedestal 25B in order to support the free cam follower 2 on the pedestal 25B.

As shown in FIG. 2, the plunger part 4E of the prop 4 is formed with a bore 4C having one end closed by an axial end of the plunger part 4E and an opposite end open. A cylindrical guide 5 is slidably inserted into the bore 4C from the open end thereof and held in slidable engagement with the adjacent one of the walls defining the space 1C owing to the action of a return spring 6 disposed in the bore 4C. The return spring 6 acts between the guide 5 and the closed end of the bore 4C to bias the prop 4 toward the first position as illustrated in FIG. 2.

As viewed in FIG. 2, the plunger part 4E is engaged with a hydraulic piston 31 of a hydraulic actuator 30. The piston 31 is slidably received in a stepped cylindrical through bore 32 with which one of the parallel extending portions of the rocker arm 1 is formed. The stepped through bore 32 has a reduced diameter bore section adjacent to the space 1C. The piston 31 is received by this reduced diameter bore section. A plug 33 closes the remote end of the through bore 32 from the space 1C. The plug 33 has a central projection that limits movement of the piston 31. Defined within the through bore 32 between the piston 31 and the plug 33 is a hydraulic pressure chamber 34.

Figure 4:
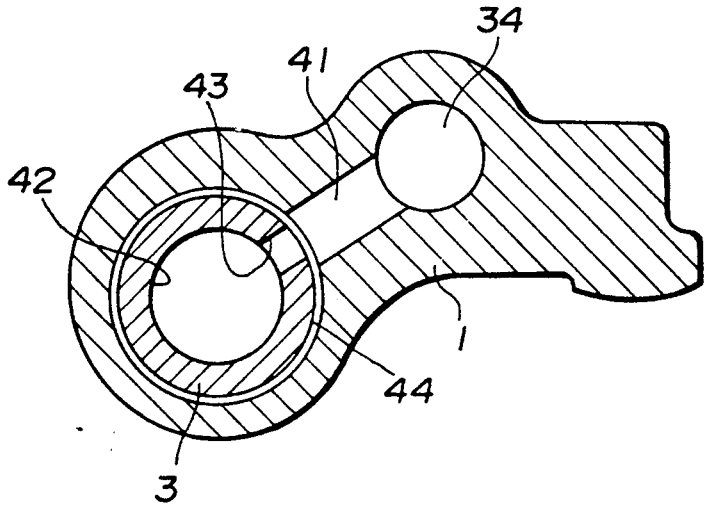
FIG. 4 is a section taken through the line IV—IV in FIG. 1.

As best seen in FIG. 4, the rocker arm 1 is formed with a through hole 41 which extends from a cylindrical bearing surface for the rocker shaft 3 to the hydraulic pressure chamber 34. The rocker shaft 3 is formed with a gallery 42, a radial port 43 and a circumferential groove 44. Fluid flow communication between the gallery 42 and the hole 41 is established by the radial port 43 and the circumferential groove 44.

Supplied to the gallery 42 is a hydraulic fluid under pressure discharged by a pump (not shown). Supply of hydraulic fluid to and discharge thereof from the gallery 42 is controlled by a two-position shift valve operated by a solenoid that is energized in response to an output signal of a control unit. The shift valve has a first position wherein hydraulic fluid is discharged from the gallery 42 and the hydraulic pressure chamber 34 and a second position wherein hydraulic fluid is supplied to the gallery 42 and the hydraulic pressure chamber 34. Thus, the pressure within the hydraulic pressure chamber 34 changes from a low level to a high level owing to this shift. Supplied to the control unit are an engine speed signal, an engine coolant temperature signal, an engine lubricant temperature signal, a signal indicative of charging owing to operation of a turbo charger, a throttle valve position signal, and etc. The control strategy followed by the control unit is such that hydraulic fluid is supplied to the chamber 34 during high speed engine operation so as to render the high speed profiled second cam lobe 22 to drive the valves 9.

As best seen in FIGS. 2 and 3, the low profiled speed profiled first cam lobe 21 and the high speed profiled second cam lobe 22 are so shaped as to meet different demands during low speed engine operation and during high speed engine operation. Specifically, at least one of a valve lift and a valve opening period provided by the profile of the high speed profiled cam lobe 22 is greater than the corresponding one of a valve lift and a valve opening period provided by the profile of the low speed profiled cam lobe 21. In this embodiment, the high speed profiled cam lobe 22 provides a valve lift and a valve opening period which are greater than their counterparts of the low speed profiled cam lobe 21.

Referring to FIG. 5, the trailing leg 4B is spaced less far from the adjacent edge of the pedestal 25B than the leading leg 4A is spaced from the adjacent edge of the pedestal 25B when the prop 4 is in the first position thereof. In FIG. 5, the reference character LA expresses a distance at which the leading leg 4A is spaced from the adjacent edge of the pedestal 25B and the reference character LB expresses a distance at which the trailing leg 4B is spaced from the adjacent edge of the pedestal 25B. The setting is such that the distance LA is longer than the distance LB. Owing to this arrangement, a smooth shift of the prop 4 is effected since, during movement of the prop 4 from the first position (see FIGS. 2 and 5) to the second position (see FIG. 6), the trailing leg 4B rides on the pedestal 25B before the leading leg 4A rides on the pedestal 25B.

Referring to FIGS. 3 and 7, the plunger part 4 4E of the prop 4 cooperates with the bore defining wall 2B for unitary rotation of the prop 4 with the free cam follower 2. Specifically, as best seen in FIG. 3, owing to this cooperation, the leading and trailing legs 4A and 4B disposed between two parallel spaced walls of the longitudinal slit 2D are held in a spaced relationship from these walls. In FIG. 3, a distance at which each of the leading and trailing legs 4A and 4B is spaced from the adjacent one of the two parallel spaced walls of the longitudinal slit 2D is expressed by the reference character L. In order to prevent misalignment of the prop 4 with the bore defined by the wall 2B of the free cam follower 2 in assembly, the setting of the distance L is such that if the projections 4D fail to align with the corresponding slots 2C, entry of the legs into the slit 2D is blocked. Thus, an error in assembly is prevented.

During operation of the engine at low speeds, the prop 4 takes the first position as illustrated in FIG. 2. In this position, the motion of the rocker arm 1 follows the profile of the low speed profiled cam lobe 21 since the motion of free cam follower 2 due to the high speed profiled cam lobe 22 is received by stroke of the cap 29 of the lost motion mechanism 25 and thus not transmitted to the rocker arm 1.

Under this condition, since the free cam follower 2 rotates about the axis 16A which is fixed relative to the rocker arm 1, the leading leg 4A slides on the end face 29*b* of the spring retainer 29 in a direction perpendicular (to the left viewing in FIG. 3) to the longitudinal line of the prop 4 when the leading leg 4A urges the spring retainer 29 against the action of the lost motion spring 26 deeply into the bore 27. Then, the leading leg 4A slides in the opposite perpendicular direction back to the position as illustrated in FIG. 3. The plunger part 4E of the prop 4 is held rigid against rotation, so that the prop 4 is always held in the predetermined appropriate position relative to the free cam follower 2 against application to torque thereto.

During operation of the engine at high speeds, the prop 4 takes the second position as illustrated in FIG. 6 since the piston 31 protrudes from the position of FIG. 2 to the position of FIG. 6 owing to a pressure build-up in the chamber 34. In this position, the free cam follower 2 is supported on the pedestal 25 fixed relative to the rocker arm 1, allowing transmission of motion of the free cam follower 2 to the rocker arm 1. Under this condition, rocker arm 1 is disengaged from the low speed profiled cam lobe 21 when the free cam follower 2 is actuated by the high speed profiled cam lobe 22 since the high speed profiled cam lobe 22 provides a higher valve lift characteristic.

For a shift from the first position illustrated in FIG. 2 to the second position illustrated in FIG. 6, the supply of hydraulic fluid to the chamber 34 begins, causing an increase in pressure in the chamber 34. This increase in pressure in the chamber 34 causes the piston 31 to move the plunger part 4E of the prop 4 to the left as viewed in FIG. 2 against the action of the spring 6. During this leftward movement of the prop 4, the trailing leg 4B rides on the pedestal 25B and then the leading leg 4A rides on the pedestal 25B.

For a shift from the second position illustrated in FIG. 6 to the first position illustrated in FIG. 2, the hydraulic fluid is discharged from the chamber 34, allowing the spring 6 to push the prop 4 and the piston 31 back to the position illustrated in FIG. 2.

From the preceding descriptions in connection with FIGS. 2 and 3, it is now well appreciated that the lost motion mechanism 25 and the prop 4 cooperate with each other to hold the cam face 2A in a predetermined relationship with the high speed profiled cam lobe 22.

Figure 8:
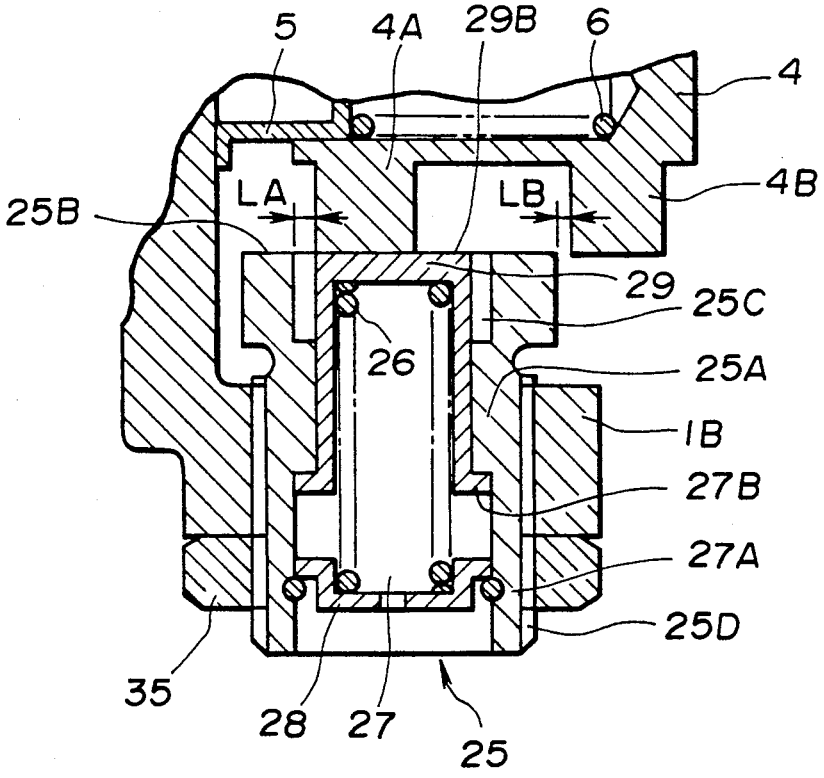
FIG. 8 is a similar view to FIG. 5, showing a portion of a second embodiment according to the present invention.
Figure 9:
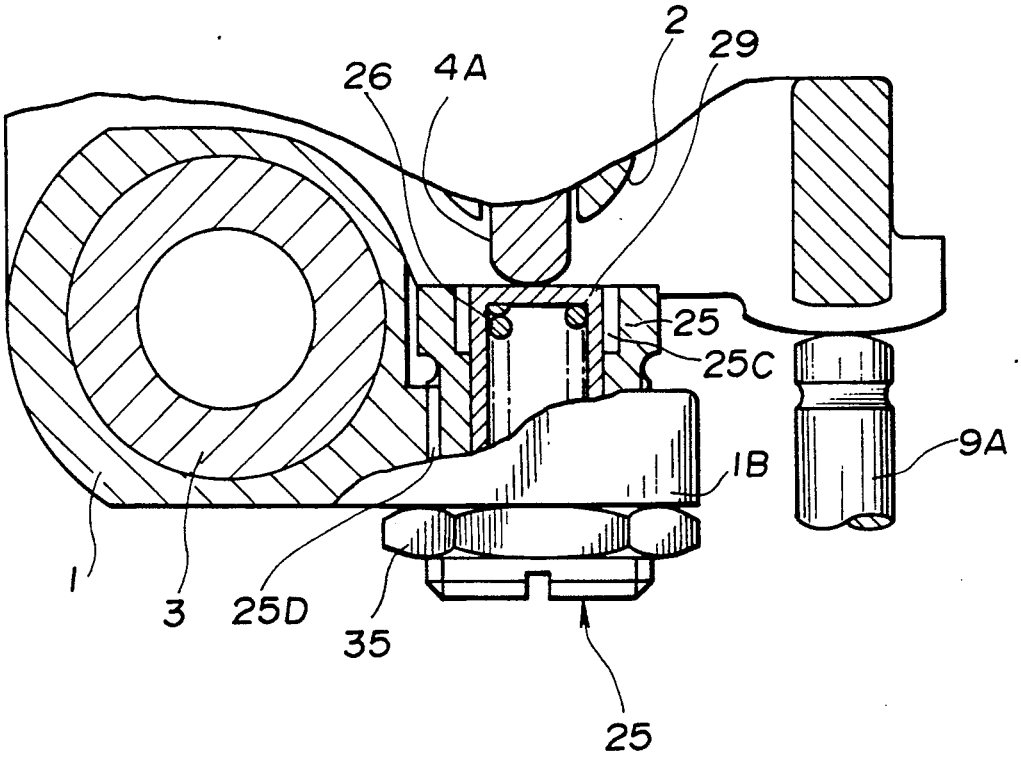
FIG. 9 is a similar view to FIG. 3, showing in enlarged scale a portion of the second embodiment.

In order to improve adjustment after assembly, a lost motion mechanism is modified in the second embodiment illustrated in FIGS. 8 and 9.

FIGS. 8 and 9 illustrate only that portion of the second embodiment which is different from the first embodiment. Briefly, the second embodiment is different from the first embodiment in that a stationary portion in the form of a barrel 25A is adjustable.

Specifically, a rocker arm 1 has an integral structure 1B formed with a bore, and the barrel 25A formed separately from the rocker arm 1 is threadedly engaged with this bore of the structure 1B. The barrel 25A is threaded at 25D on its outer periphery. A lock nut 35 is threadedly engaged wirh the barrel 25A to hold the barrel 25A in a fixed relationship with the rocker arm 1 after adjustment. In order to avoid collision of a leading leg 4A with the barrel 25A on its bore 27 defining wall, the diameter of the bore 27 is enlarged at 25C (see FIG. 9).

Figure 10:
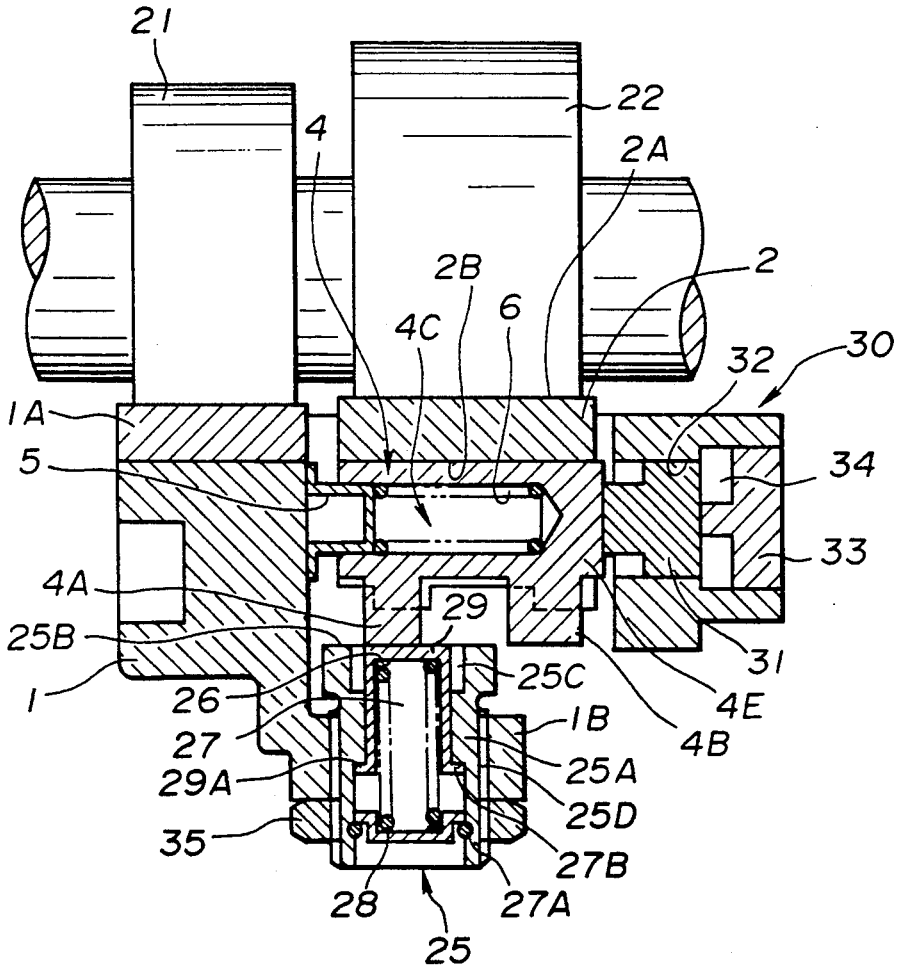
FIG. 10 is a similar view to FIG. 2, showing a third embodiment according to the present invention.
Figure 11:
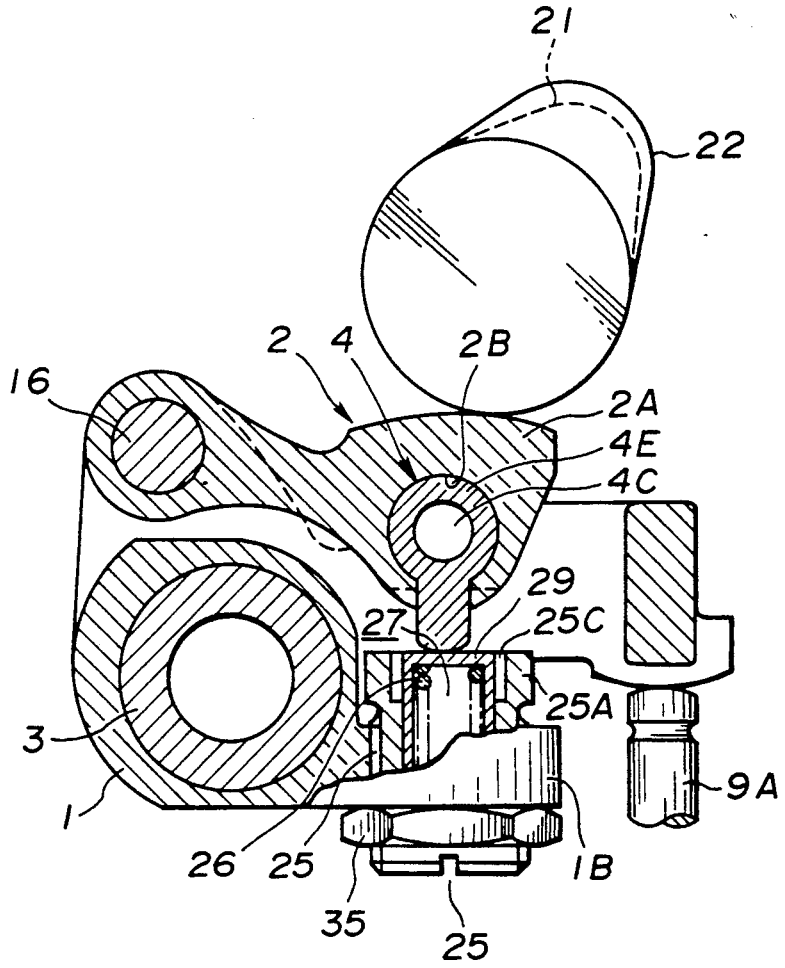
FIG. 11 is a similar view to FIG. 3, showing the third embodiment.

The third embodiment is described in connection with FIGS. 10 and 11. This embodiment is substantially the same as the second embodiment except the fact that a plunger part 4E of a prop 4 slidably fits in a bore defining wall 2B of a free cam follower 2.

What is claimed is:

1. An apparatus for actuating a valve of an engine having a camshaft with a first cam lobe and a second cam lobe, the valve having a valve stem, comprising:

a rocker shaft having an axis;

a rocker arm supported by said rocker shaft for rotational movement about said axis and adapted for contacting with said first cam lobe and the valve stem;

a lost motion mechanism including a stationary portion defining a pedestal fixed to said rocker arm and a moveable portion received by said stationary portion for movement relative to said stationary portion;

a free cam follower including a cam face adapted for contacting with said second cam lobe;

a prop supported by said free cam follower for movement between a first position in which said prop supports said free cam follower on said moveable portion of said lost motion mechanism and a second position in which said prop supports said free cam follower on said pedestal, said free cam follower having a bore and wall means defining said bore, and said prop having a plunger part received in said bore and cooperating with said bore defining wall means for unitary rotation of said prop with said free cam follower, and said lost motion mechanism and said prop cooperating with each other to hold said cam face in a predetermined relationship with said second cam lobe.

2. An apparatus as claimed in claim 1, wherein said plunger part is formed with a plurality of projections and said bore defining wall means include a plurality of slots slidably receiving said plurality of projections, respectively.

3. An apparatus as claimed in claim 2, wherein said rocker arm is formed with a bore, and said stationary portion of said lost motion mechanism is in the form of a barrel formed separately from said rocker arm and threadedly engaged with said bore of said rocker arm.

4. An apparatus as claimed in claim 3, wherein said free cam follower and said prop are disposed between said lost motion mechanism and the second cam lobe.

5. An apparatus as claimed in claim 4, wherein said prop has a first leg and a second leg, said first and second legs extending radially outwardly from said plunger part and being constructed and arranged relative to said pedestal such that said second leg comes into engagement with a portion of said pedestal before said first leg comes into engagement with another portion of said pedestal during movement of said prop toward said second position thereof from said first position thereof.

6. An apparatus as claimed in claim 5, wherein said free cam follower is mounted to said rocker arm for rotatable movement about a second axis which is held in a predetermined parallel and spaced relationship with said axis of said rocker arm.

7. An apparatus as claimed in claim 6, wherein said first leg of said prop is in slidable engagement with said moveable portion during rotatable movement of said free cam follower about said second axis when said prop is in said first position thereof.

8. An apparatus as claimed in claim 2, wherein said stationary portion of said lost motion mechanism is in the form of a barrel formed integrally with said rocker arm.

9. An apparatus as claimed in claim 1, wherein said rocker arm is formed with a bore, and said stationary portion of said lost motion mechanism is in the form of a barrel formed separately from said rocker arm and threadedly engaged with said bore of said rocker arm.

10. An apparatus as claimed in claim 9, wherein said lost motion mechanism includes lock nut means for holding said barrel in a fixed relationship with said rocker arm.

11. An apparatus as claimed in claim 8, wherein said barrel is formed with a bore, and said moveable portion having an end face and slidably received in said bore of said barrel for movement to a rest position in which said end face is held in a predetermined relationship with said pedestal.

12. An apparatus as claimed in claim 9, wherein said barrel is formed with a bore, and said moveable portion having an end face and slidably received in said bore of said barrel for movement to a rest position in which said end face is held in a predetermined relationship with said pedestal.

13. An apparatus as claimed in claim 11, wherein said lost motion mechanism includes an end plug fixed to said bore of said barrel and a spring acting between said end plug and said moveable portion.

14. An apparatus as claimed in claim 13, wherein said bore of said barrel includes a first bore section and a second reduced diameter bore section which is reduced in diameter than said first bore section and connected to said first bore section via a shoulder.

15. An apparatus as claimed in claim 14, wherein said moveable portion of said lost motion mechanism includes a tubular wall slidably fit in said second reduced diameter bore section, and said tubular wall has one end closed by said end face and the opposite end formed with a flange adapted for engagement with said shoulder.

* * * * *